United States Patent [19]

Ritter

[11] Patent Number: 4,814,564

[45] Date of Patent: Mar. 21, 1989

[54] ACCELERATION SWITCH

[75] Inventor: Heinz Ritter, Schongau, Fed. Rep. of Germany

[73] Assignee: SDS-Relais AG, Deisenhofen, Fed. Rep. of Germany

[21] Appl. No.: 116,344

[22] Filed: Nov. 4, 1987

[30] Foreign Application Priority Data

Nov. 11, 1986 [DE] Fed. Rep. of Germany ..... 3638504

[51] Int. Cl.[4] ..... H01H 3/60

[52] U.S. Cl. ..... 200/288; 200/61.49; 200/301

[58] Field of Search ..... 200/288, 301, 61.49, 200/61.5, 61.51

[56] References Cited

U.S. PATENT DOCUMENTS 2,071,384 2/1937 Barrett ..... 200/301
4,053,729 10/1977 Reiter ..... 200/288

FOREIGN PATENT DOCUMENTS 887970 8/1953 Fed. Rep. of Germany .
1025523 3/1958 Fed. Rep. of Germany ..... 200/288
1045514 12/1958 Fed. Rep. of Germany ..... 200/288
1175807 8/1964 Fed. Rep. of Germany .

*Primary Examiner*—Renee S. Luebke
*Attorney, Agent, or Firm*—Foley & Lardner, Schwartz, Jeffery, Schwaab, Mack, Blumenthal & Evans

[57] ABSTRACT

A bounce-free acceleration switch includes a resiliently mounted movable contact (14) which cooperates with a counter contact (15). The kinetic energy of the movable contact (14) is transmitted through an impact body (16) to a resiliently mounted massive body (17) which, when swinging back to its rest position, engages a stop (18). Re-transmission of the kinetic energy from the massive body (17) to the impact body (16) and thus to the contact couple (14, 15), which would cause contact bouncing, is prevented by providing a spacing (s) between the massive body (17) and the impact body (16) in the rest position of the apparatus, and by the fact that during the deflecting and swinging-back movement of the massive body (17) the impact body (16) returns towards its rest position and is therefore not hit again by the massive body (17).

8 Claims, 1 Drawing Sheet

ACCELERATION SWITCH

BACKGROUND OF THE ADVENTURE

This invention relates to an electrical contact apparatus.

In a prior art contact apparatus known from German Pat. specification No. 1,055,712, a resiliently mounted movable contact cooperates with a counter contact that is also resiliently mounted. In the rest position of the apparatus, a massive body which is again resiliently mounted rests against the counter contact at the side remote from the movable contact. When the movable contact is actuated by exciting a solenoid and hits the counter contact, the kinetic energy of the movable contact is transmitted through the counter contact onto the massive body. Under the condition that the masses of the movable contact and the massive body are substantially equal, the movable contact and the counter contact will retain no kinetic energy and the counter contact will remain in its rest position so that the contact is held closed without bouncing as long as the excitation of the solenoid persists. The massive body is deflected in the impact direction by the kinetic energy transmitted to it, thereby moving away from the rear side of the counter contact.

To prevent the massive body from subsequently swinging back and again transmitting its energy to the contact couple, one embodiment of the prior art apparatus includes a permanent magnet which holds the massive body in its deflected position. In this case, the massive body is returned from its rest position by means of a bracket which pulls the massive body away from the permanent magnet, the bracket being fixed to the movable contact so as to return with the same when the excitation of the solenoid is switched off. This mechanism, however, requires the spring carrying the movable contact to excert a high resetting force, so that this contact apparatus is suited only for such applications in which a high actuating force is available.

In another embodiment of the prior art contact apparatus, the massive body is connected to the piston of a damping cylinder, the piston being provided with valves that are open when the piston moves in the deflecting direction and are closed during return movement, thereby damping the return movement. The damping mechanism provided in this case, however, it too expensive and bulky for many applications.

A disadvantage common to both of the prior art locking or damping mechanisms further resides in the fact that they considerably reduce the maximum switching frequency because the massive body is delayed in returning to its starting position.

German patent specification No. 972,236 discloses a further electrical contact apparatus which exploits the physical principle of the elastic impact, but it does so for achieving a fast-switching behaviour rather than for avoiding contact bouncing.

SUMMARY OF THE INVENTION

It is an object of the invention to provide a contact apparatus in which contact bouncing is avoided by inexpensive means which require little space and which influence the switching characteristic as little as possible.

This object is met according to the invention by an electrical contact apparatus including a resiliently mounted movable contact, a counter contact cooperating therewith, a resiliently mounted massive body adapted to be moved in a deflecting direction aligned with the closing direction of the movable contact by the kinetic energy of the movable contact being transmitted to the massive body, to avoid contact bouncing, said massive body, in the rest position of the contact apparatus, resting against a stop which limits its movement in a direction opposite to said deflecting direction, and being spaced from a structural member which transmits the kinetic energy to the massive body.

The stop provided in the above apparatus serves to take up the kinetic energy of the massive body when the latter swings back to its rest position. The spacing which exists in the rest position of the contact apparatus between the massive body and the structural member that transmits the kinetic energy of the movable contact to the massive body, prevents the massive body from again hitting the said structural member when swinging back to its rest position, thereby avoiding that the kinetic energy again acts on the contact system. Since the spring that carries the massive body and biasses it against the stop may be made comparatively stiff, the massive body quickly returns to its rest position without affecting the switching frequency of the contact apparatus. The stop may be manufactured practically without additional expense, and the said spacing does not have to be larger than e.g. 0.1 mm in practice, so that the overall arrangement is compact and inexpensive.

The contact apparatus of the present invention is therefore particularly suited for acceleration switches such as are used in road vehicles to control seat belts or similar holdback devices.

DESCRIPTION OF THE PREFERRED EMBODIMENTS

Figure 1:
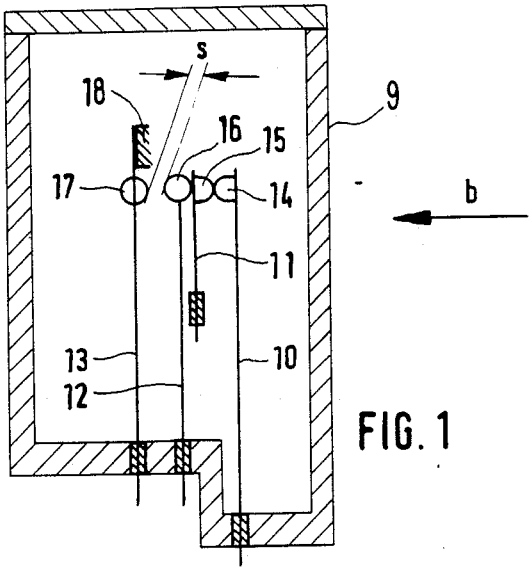
FIGS. 1 and 2 are schematic illustrations of two embodiments of the invention.

Two embodiments will now be described with reference to the schematic representations shown in the drawing.

In the electrical contact apparatus schematically shown in FIG. 1, four leaf springs 10...13 are mounted on a housing member 9, with the other, free end of the leaf spring 10 carrying a movable contact 14, that of the leaf spring 11 carrying a counter contact 15, that of the leaf spring 12 carrying an impact body 16 and that of the leaf spring 13 carrying a massive body 17. The leaf spring 13 is biassed such that, in the rest position of the apparatus, it rests against a stop 18 in the area of its free end. In this rest position, the massive body 17 is spaced from the impact body 16 by a spacing s. The leaf spring 11 is comparatively short and stiff so that the counter contact 15 is movable only by small amounts to form the "fixed" contact of the contact couple 14, 15.

When an acceleration acts in the direction of the arrow b on the contact apparatus shown in FIG. 1, the leaf spring 10 is deflected clockwise in FIG. 1, while a corresponding displacement of the massive body 17 is prevented by the stop 18, and the displacement of the impact body 16 and counter contact 15 is limited by the comparatively short and stiff leaf spring 11. The contact couple 14, 15 is thereby opened.

When the acceleration ceases, the movable contact 14 is returned by the force of the leaf spring 10, thereby hitting the counter contact 15 so that the contact couple is again closed. The kinetic energy of the movable contact 14 is thereby transmitted through the counter contact 15 and the impact body 16 onto the massive body 17 which, until then, has been retained in its rest position by the bias of the leaf spring 13. When the masses of the contact 14, the impact body 16 and the massive body 17 are made equal, practically the entire kinetic energy of the movable contact 14 is transmitted to the massive body 17 which is thereby deflected counter-clockwise in FIG. 1 and will subsequently swing back to its rest position at the stop 18. During this deflecting and swinging-back movement of the massive body 17, the impact body 16 has been returned by its leaf spring 12 towards its rest position so that it will not again be hit by the massive body 17 which, in turn, will ultimately transmit its kinetic energy to the stop 18. Since the impact body 16 has lost its kinetic energy, it will not cause a noticeable impact on the contact couple when returning so that contact bouncing is effectively avoided.

The leaf spring carrying the impact body may be softer than the leaf spring carrying the massive body.--.

Figure 2:
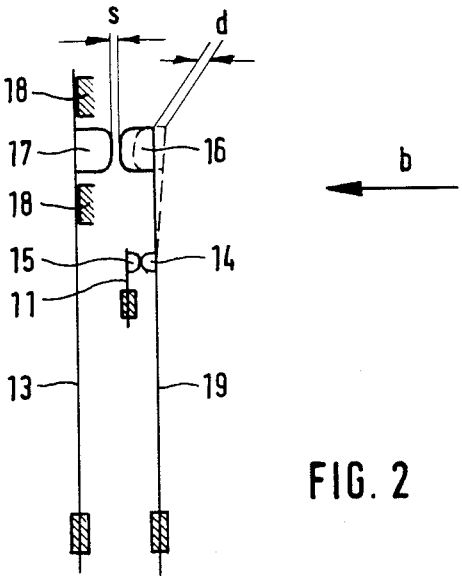

The embodiment of FIG. 2 differs from that of FIG. 1 in that the movable contact 14 is mounted at an intermediate position of the leaf spring 19 which carries the impact body 16 at its free end. Also, the impact and massive bodies 16, 17 have identical masses whereas the contacts 14 and 15 have considerably smaller masses.

When an acceleration in the direction of the arrow b acts on the contact apparatus shown in FIG. 2, the leaf spring 19 is deflected clockwise in FIG. 2 while the massive body 17 is retained in its rest position by the stop 18 which is fixed to the housing. Upon ceasing of the acceleration, the contact spring 19 moves in the opposite direction thereby closing the contact couple 14, 15, and the impact body 16, in bending the upper portion of the leaf spring 19 about the contact position, will hit the massive body 17 thereby transmitting its kinetic energy onto the latter. In this case, the spacing s which exists in the rest condition between the massive body 17 and the impact body 16, must be smaller in a length d by which the impact body 16 may be displaced in bending the leaf spring 19 without opening the contact couple 14, 15, in order that contact bouncing is prevented or at least limited to a very small period of time.

In the two embodiments described above, the various leaf springs, particularly the leaf spring 10 or 19 carrying the movable contact 14, are so dimensioned that, in the rest position, the contact couple is held closed with a predetermined bias and is opened only upon occurrence of an acceleration which exceeds a limit value corresponding to this bias. In the above application, this limit value is at about 4 to 5 times gravity.

The position of the counter contact 15 may be adjusted to change the spacing s. This adjustment may be made e.g. by adjusting the spring 11. The spacing s is preferably selected as small as possible as long as it ensures that the massive body 17 on swinging back does not reach the impact body 16.

In the embodiment of FIG. 1, the massive body 17 and the impact body 16 may be formed integrally with their respective leaf springs 13 and 12, e.g. of synthetic material, and they may further be formed integrally with a housing member of the contact apparatus. This results in a particularly inexpensive manufacture of the apparatus. In the embodiment of Figure 2, the same is not possible for the leaf spring 19 which carries the contact 14 and must therefore be conductive.

I claim:

1. An electrical contact apparatus including a movable contact resiliently mounted for movement in an opening contact coupling direction and a closing contact coupling direction, a counter contact cooperating therewith, a resiliently mounted massive body, an impact body cooperating with said massive body, and stop means;

said resiliently mounted massive body being adapted to be moved in a deflecting direction aligned with said closing contact coupling direction of the movable contact by the kinetic energy of said movable contact being transmitted to the massive body, to avoid contact bouncing, said impact body being adapted for movement from a rest position, in which it is able to take up the kinetic energy from said movable contact, to a deflected position, in which it is able to transmit said kinetic energy to said massive body, and subsequent automatic return to said rest position, said massive body, in the rest position of the contact apparatus, resting against said stop means which limits its movement in a direction opposite to said deflecting direction at a location spaced from said impact body.

2. The contact apparatus of claim 1, wherein said impact body is resiliently mounted.

3. The contact apparatus of claim 1, wherein the impact body is disposed between the counter contact and the massive body in the direction of movement of said impact body.

4. The contact appartus of claim 1, wherein the movable contact is disposed at an intermediate location of a leaf spring which at its free end carries the impact body.

5. The contact apparatus of claim 4, wherein spacing exists between the massive body and the impact body in said rest position and said spacing is smaller than the amount by which the leaf spring carrying the impact body is capable of bending without causing the movable contact to leave the counter contact.

6. The contact apparatus of claim 1, wherein said impact body and massive body are each carried by a leaf spring, and wherein the leaf spring carrying the impact body is softer than the leaf spring carrying the massive body.

7. The contact apparatus of claim 1, including leaf springs carrying said impact body and said massive body, and wherein the massive body and the impact body including the springs are formed of the same material as a housing member of the contact apparatus.

8. The contact apparatus of claim 1, including leaf springs carrying the impact body and wherein the massive body and the impact body including said springs are formed integrally with a housing member of the contact apparatus.

* * * * *